US007109885B1

(12) United States Patent
Denlinger

(10) Patent No.: US 7,109,885 B1
(45) Date of Patent: Sep. 19, 2006

(54) PORTABLE EXPANDABLE SCREEN

(76) Inventor: Timothy Denlinger, 1140 Woods Dr., Womelsdorf, PA (US) 19567

( * ) Notice: Subject to any disclaimer, the term of this patent is extended or adjusted under 35 U.S.C. 154(b) by 128 days.

(21) Appl. No.: 10/972,254

(22) Filed: Oct. 22, 2004

(51) Int. Cl.
*G08G 1/045* (2006.01)

(52) U.S. Cl. ..... 340/908; 340/473; 340/907; 340/908.1; 116/63 R; 116/63 P; 160/10; 160/218; 256/13.1; 404/6; 404/9

(58) Field of Classification Search ..... 340/473, 340/907, 908, 908.1; 116/63 R, 63 P; 160/10, 160/218, 222; 256/13.1; 404/6, 9
See application file for complete search history.

(56) References Cited

U.S. PATENT DOCUMENTS

| | | | | |
|---|---|---|---|---|
| 4,124,196 | A | 11/1978 | Hipskind | 256/1 |
| 4,186,912 | A | 2/1980 | Byrd, Jr. | 256/1 |
| 4,465,262 | A | 8/1984 | Itri | 256/24 |
| 5,269,623 | A | 12/1993 | Hanson | 404/6 |
| 5,595,230 | A | 1/1997 | Guerra | 160/135 |
| 6,036,249 | A | 3/2000 | Kuntz | 296/1.1 |
| 6,037,866 | A | 3/2000 | Leibowitz | 340/473 |
| 6,435,253 | B1 | 8/2002 | Steeves | 160/135 |
| 6,676,113 | B1 * | 1/2004 | Christensen et al. | 256/25 |
| 6,733,204 | B1 * | 5/2004 | Paniccia | 404/6 |
| 2002/0117270 | A1 | 8/2002 | Steeves | 160/135 |

* cited by examiner

*Primary Examiner*—Jeffery Hofsass
*Assistant Examiner*—Samuel J. Walk
(74) *Attorney, Agent, or Firm*—Goldstein Law Offices P.C.

(57) ABSTRACT

A portable expandable screen for blocking passing motorists' and pedestrians' views of accidents on a roadway to prevent rubbernecking and promote traffic flow and increased highway safety. The portable expandable screen has a plurality of panels assembled in a telescoping manner like an accordion. Each panel has an outside surface, an inside surface, an inside edge, and a bottom end. A horizontal track is located on the inside surface at the bottom end of every panel. A small wheel is fixed to the inside edge at the bottom end of every panel, for allowing the small wheel of one panel to be fitted within the track of an adjacent panel. This allows the panels to slide inwardly and outwardly in a telescoping manner to block accidents from view on the roadways.

7 Claims, 4 Drawing Sheets

PORTABLE EXPANDABLE SCREEN

BACKGROUND OF THE INVENTION

The invention relates to a screen, and more particularly, to a portable expandable screen for blocking passing motorists' and pedestrians' views of accidents on a roadway to prevent rubbernecking and promote traffic flow and increased highway safety.

Rubbernecking is the phenomena of motorists slowing down to observe an accident or anything unusual on the side of the road. Rubbernecking has gotten so bad that in some areas electronic traffic billboards started carrying messages which read, "Accident Ahead: Please Don't Rubberneck." Displaying this message did not last very long as there was no evidence that it worked and it may have actually piqued drivers' curiosity and caused even more rubbernecking. In rubbernecking, a drivers' eyes involuntarily dart to the side of the road, while their foot instinctively lifts off of the gas pedal. The momentary slow down creates an imbalance in the space between cars, leading to what engineers affectionately card "accordion effect" as drivers halt and then accelerate. And, in a very short time drivers have concocted a traffic jam of their very own. That action shrinks the carrying capacity of the road, almost the same way a closed lane does. The effect bounces backward one car at a time, in a shock wave that lasts independently of the initial problem, so that there's often not even anything for the rubberneckers to see.

U.S. Pat. No. 6,036,249 to Kuntz discloses an accident shield device. U.S. Pat. No. 4,124,196 to Hipskind discloses a portable device for screening off an accident scene from view. U.S. Pat. No. 5,269,623 to Hanson discloses a rapidly deployable traffic screen. U.S. Pat. No. 4,465,262 to Itri et al. discloses a portable expandable barrier. U.S. Pat. No. 6,037,866 to Leibowitz discloses a hazard device for a vehicle. U.S. Pat. No. 4,186,912 to Byrd discloses a accident screen. U.S. Pat. No. 5,595,230 to Guerra discloses a crime scene body shield. U.S. Pat. No. 6,435,253 and United States publication #2002/0117270 A1 both to Steeves et al. discloses an extendable partition assembly.

While these units may be suitable for the particular purpose employed, or for general use, they would not be as suitable for the purposes of the present invention as disclosed hereafter.

SUMMARY OF THE INVENTION

It is an object of the invention to produce an improved screen for preventing rubbernecking and increasing highway safety. Accordingly, the invention is a portable expandable screen having a plurality of panels which are assembled in a telescoping manner like an accordion, for blocking passing motorists' and pedestrians' views of accidents on a roadway to prevent rubbernecking and promote traffic flow and increased highway safety.

It is another object of the invention to provide a portable expandable screen that is easily assembled and disassembled. Accordingly, the invention has a retracting motor for easily lowering and lifting the portable expandable screen out of and into a flatbed of a truck, for easily being assembled and disassembled. In addition, the panels each have a ground wheel for facilitating expansion and contraction and allowing the portable expandable screen to be open and closed easily.

It is another object of the invention to provide a portable expandable screen, which prevents drivers' and pedestrians from seeing therethrough, while still allowing wind to pass therethrough. Accordingly, the invention is made from a plurality of horizotal plastic strips surrounded by an aluminum frame, which allows wind to flow therethrough, but prohibits drivers' and pedestrians' from seeing therethrough.

This invention is a portable expandable screen for blocking passing motorists' and pedestrians' views of accidents on a roadway to prevent rubbernecking and promote traffic flow and increased highway safety. The portable expandable screen has a plurality of panels assembled in a telescoping manner like an accordion. Each panel has an outside surface, an inside surface, an inside edge, and a bottom end. A horizontal track is located on the inside surface at the bottom end of every panel. A small wheel is fixed to the inside edge at the bottom end of every panel, for allowing the small wheel of one panel to be fitted within the track of an adjacent panel. This allows the panels to slide inwardly and outwardly in a telescoping manner to block accidents from view on the roadways.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
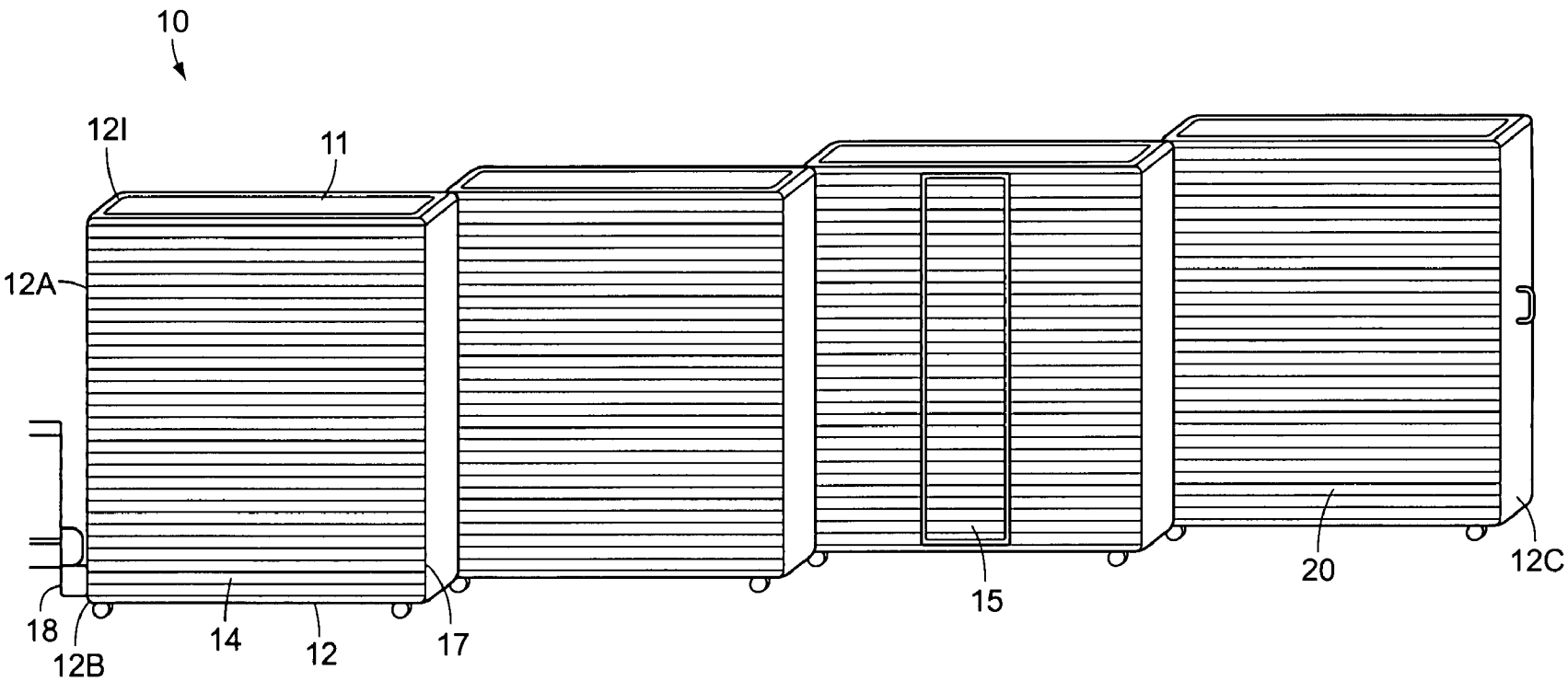
FIG. 1 is a diagrammatic perspective view of the portable expandable screen of the present invention having a plurality of panels for blocking passing motorists' and pedestrians' views of accidents on a roadway to prevent rubbernecking and promote traffic flow and increased highway safety.

FIG. 1 illustrates a portable expandable screen 10 for blocking passing motorists' and pedestrians' views of accidents on a roadway to prevent rubbernecking and promote traffic flow and increased highway safety. The portable expandable screen device 10 includes a plurality of panels 12 which are assembled in an accordion type manner. One of the panels 12 is a base panel 14 while another panel is an outermost panel 20. Each of the panels 12 has an outside surface 12O, inside surface 12I, and bottom end 12B, an inside edge 12A, and an outside edge 12C. Preferably, there are 12 panels, each 9 feet in length, by 8 feet in height, by approximately 4 inches in width. Preferably, the panels are made from a plurality of horizontally extending plastic strips 11 surrounded by an aluminum frame 17, which allows wind to flow therethrough, and does not produce any drag while in transit, but prohibits passerby's from seeing therethrough. The panels 12 are slidably connected together from the base panel 14 to the outermost panel 20 and are assembled in a telescoping manner. A retracting motor 18 is attached to the inside edge 12A of the base panel 14.

One or more of the panels 12 can include an access door 15, built therein, which opens and closes like a conventional door. This allows stretchers, medical, and fire personal to enter and exit therethrough without having to circumvent the entire portable expandable screen 10.

Figure 2:
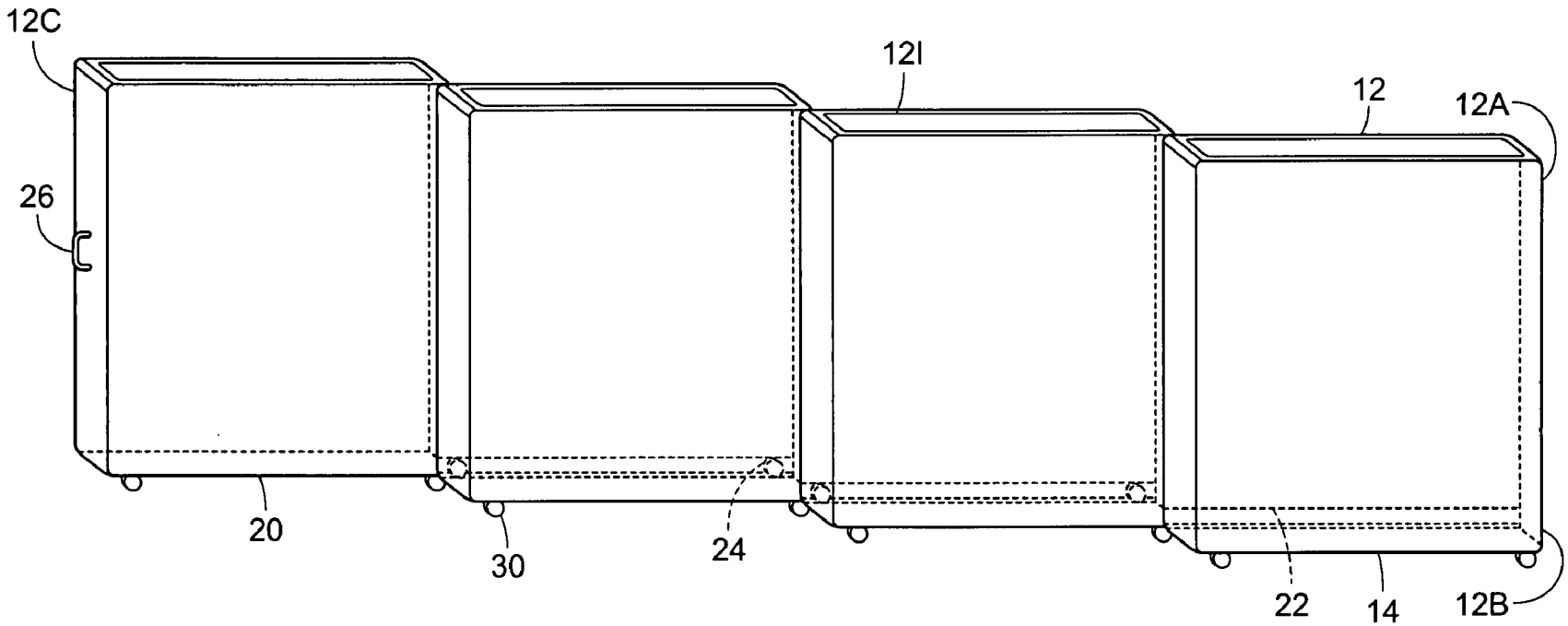
FIG. 2 is a rear view of the portable expandable screen of the present invention, wherein the panels are assembled together in a telescoping manner like an accordion.

FIG. 2 illustrates the portable expandable screen 10, wherein the panels 12 are assembled together in a telescoping manner like an accordion. The panels 12 are slideably connected together. A horizontal track 22 is located on the inside surface 12I at the bottom end 12B of every panel 12, except the outermost panel 20. A small wheel 24 is fixed to the inside edge 12A at the bottom end 12B of every panel 12, except the base panel 14. The small wheel 24 of one panel 12 is fitted within the track 22 of an adjacent panel 12 and slides along the track 22 like an accordion to expand and contract. The outermost panel 20 has a handle 26 attached to the outside edge 12C for helping a user to facilitate expanding the panels 12 to a desired length.

Each of the panels has a ground wheel 30 attached to the bottom end 12B near the outside edge 12C for helping to slide the panels 12 outwardly into position, and back inwardly for transport and storage.

Figure 3:
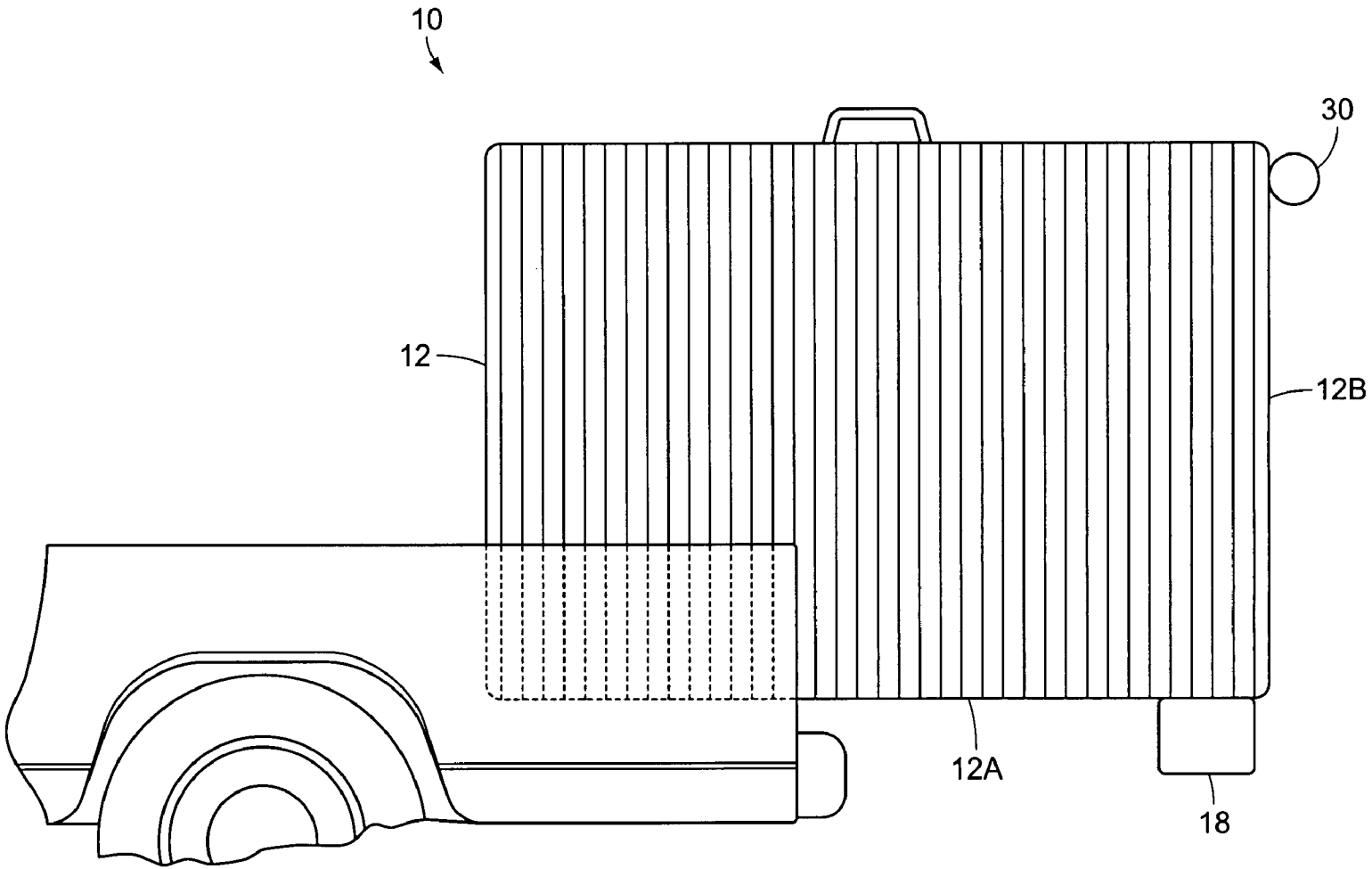
FIG. 3 is a side elevational view of the portable expandable screen in use being assembled and disassembled.
Figure 4:
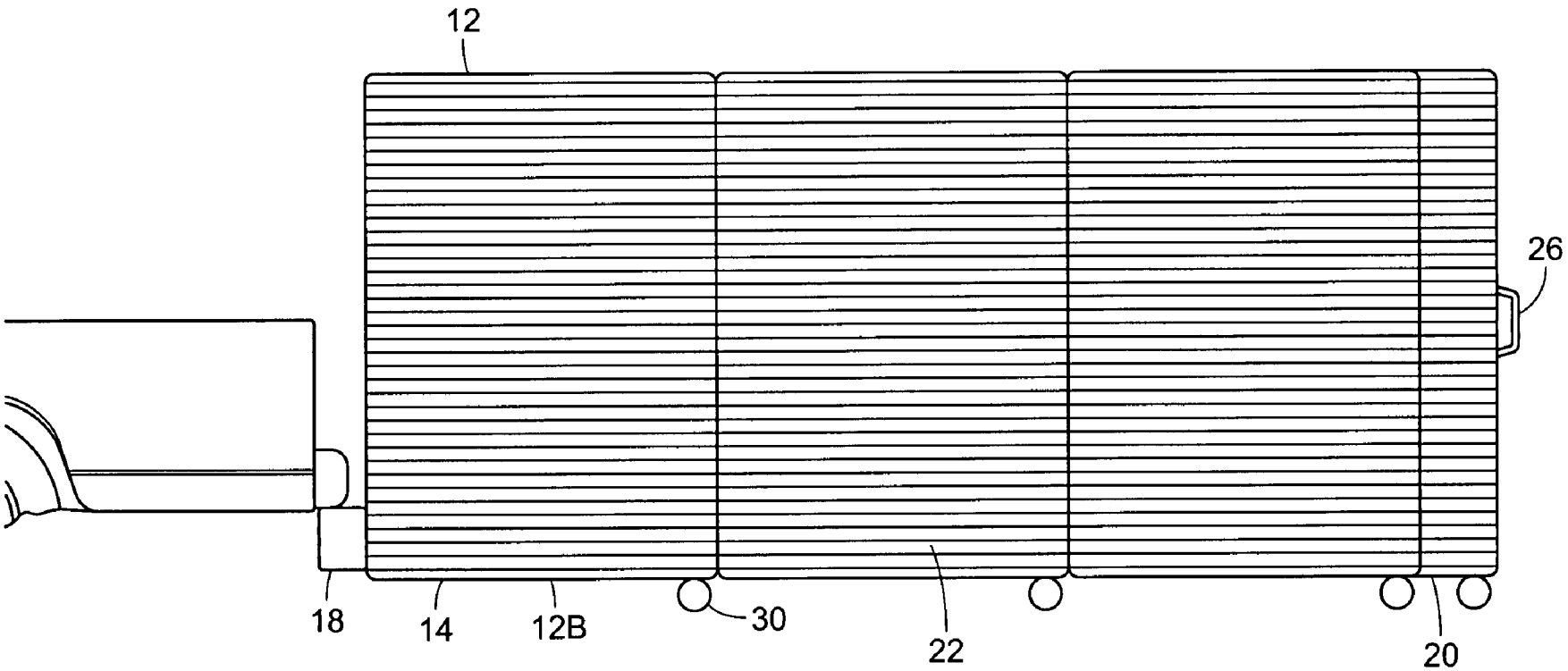
FIG. 4 is a side elevational view of the portable expandable screen in use being assembled and disassembled.

FIGS. 3 and 4 illustrates the portable expandable screen 10 in use being assembled and disassembled. When an accident occurs, the portable expandable screen 10 is transported by trailer or truck, having a flatbed, to the accident site. The inside edge 12A of each panel are positioned flat against the flatbed of the truck for transport. Once at the site, the portable expandable screen 10 is assembled for use. First, the retracting motor 18 is actuated to slide the panels 12 outwardly, away from the flatbed, and to rotate the panels 12 rightside up before lowering the bottom end 12B of the panels 12 to a ground, with the ground wheels 30 touching the ground. The retracting motor 18 is of the type conventionally used to lower an apparatus out from a truck, and lift an apparatus back into the truck for transport and storage after use. Once in position on the ground, the telescoping panels 12 of the portable expandable screen 10 are slidably pulled open by pulling the handle 26 on the outermost panel 20 and thereby extending outwardly each panel 12 one at a time starting with the outermost panel 12 and allowing the panels 12 to slide open along the tracks 22 of the adjacent panel 12. The panels 12 telescope outwardly until the accident is completely blocked from view of drivers or pedestrians passing by. It should be noted that the ground wheels 30 may be provided in pairs of ground wheels on a common axle, such that the pair of ground wheels lend stability to the panel 12. To facilitate retracting the panels 12 then, the pairs of ground wheels would be located in staggered locations on adjacent panels 12.

After the accident or other disturbance has cleared, the portable expandable screen 10 is disassembled for transport and storage. First, the handle 26 on the outermost panel 20 is pushed inwardly and the panels 12 individually slide along the tracks 22 of the adjacent panel 12 to close together like an accordion, starting with the outermost panel 20 and finishing with the base panel 14. Once closed, the portable expandable screen 10 is lifted up and rotated sideways and positioned on top the flatbed by the retracting motor 18.

In conclusion, herein is presented a portable expandable screen. The invention is illustrated by example in the drawing figures, and throughout the written description. It should be understood that numerous variations are possible, while adhering to the inventive concept. Such variations are contemplated as being a part of the present invention.

What is claimed is:

1. A portable expandable screen for blocking passing motorists' and pedestrians' views of accidents on a roadway to prevent rubbernecking and promote traffic flow and increased highway safety, comprising:

a plurality of telescoping panels assembled in an accordion type manner, one of the panels being a base panel, and another panel being an outermost panel, each of the panels having an outside surface, an inside surface, a bottom end, an inside edge, and an outside edge, the panels each having a plurality of horizontally extending plastic strips surrounded by an aluminum frame;

a retracting motor attached to the inside edge of the base panel for lowering and lifting the portable expandable screen into and out of a truck for transport and storage;

a horizontal track located on the inside surface at the bottom end of every panel;

a small wheel fixed to the inside edge at the bottom end of every panel, the small wheel of one panel being fitted within the track of an adjacent panel for sliding along the track to allow expansion and contraction;

a handle attached to the outside edge of the outermost panel for helping a user to facilitate expanding the panels;

a ground wheel attached to the bottom end of each panel near the outside edge for helping to slide the panels outwardly into position, and back inwardly for transport and storage; and an access door, built within at least one panel which opens and closes for allowing access therethrough when the portable expandable screen is assembled.

2. A portable expandable screen for blocking passing motorists' and pedestrians' views of accidents on a roadway to prevent rubbernecking and promote traffic flow and increased highway safety, being transport within a truck for use by a user, comprising:

a plurality of telescoping panels assembled in an accordion type manner, one of the panels being a base panel, and another panel being an outermost panel, each of the panels having an outside surface, inside surface, a bottom end, an inside edge, and an outside edge;

a horizontal track located on the inside surface at the bottom end of every panel;

a small wheel fixed to the inside edge at the bottom end of every panel, the small wheel of one panel being fitted within the track of an adjacent panel for sliding along the track to allow expansion and contraction; and a ground wheel attached to the bottom end of each panel near the outside edge for helping to slide the panels outwardly into position, and back inwardly for transport and storage.

3. The portable expandable screen of claim 2, wherein the panels each having a plurality of horizontal plastic strips surrounded by an aluminum frame, for allowing wind to flow therethrough, but prohibiting the drivers' and pedestrians' from seeing therethrough.

4. The portable expandable screen of claim 3, further comprising a retracting motor attached to the inside edge of the base panel for lowering and lifting the portable expandable screen into and out of the truck.

5. The portable expandable screen of claim 4, further comprising a handle attached to the outside edge of the outermost panel for helping the user to facilitate expanding and contracting the panels.

6. The portable expandable screen of claim 5, further comprising an access door, built within at least one panel, which opens and closes for allowing access therethrough when the portable expandable screen is assembled.

7. A method of using a portable expandable screen after an accident occurs for blocking passing motorists' and pedestrians' views of accidents, the portable expandable screen is transported to a site by a truck having a flatbed, the portable expandable screen having a plurality of panels, one of the panels is an outermost panel and another panel is a base panel, each panel having an inside edge, an outside edge, an inside surface, an outside surface, and a bottom end, the panels having one ground wheel attached to each bottom end, a handle is attached to the outside edge of the outermost panel, a retracting motor attached to the base panel, a horizontal track located on the inside surface at the bottom end of every panel, a small wheel fixed to the inside edge at the bottom end of every panel, the small wheel of one panel being fitted within the track of an adjacent panel, the steps comprising:

lowering the portable expandable screen from the flatbed of the truck, by actuating the retracting motor which slides the panels out from the flatbed and rotates the panels right side up, and lowers the bottom end of the panels to a ground surface, with the ground wheels touching the ground surface;

assembling the portable expandable screen by sliding the panels open by pulling the handle on the outermost panel and extending outwardly each panel one at a time starting with the outermost panel and allowing the panels to slide open along the tracks of the adjacent panel, the panels telescoping outwardly until the accident is completely blocked from view of drivers or pedestrians passing by;

disassembling the portable expandable screen by pushing the handle on the outermost panel inwardly and allowing each panel to individually slide along the tracks of the adjacent panel to close together starting with the outermost panel and finishing with the base panel; and lifting the portable expandable screen onto the flatbed of the truck by actuating the retracting motor for lifting the panels upwardly and rotating the panels sideways, and positioning the panels with the inside edge flat against the flatbed of the truck for transport and storage.

* * * * *